United States Patent [19]

Robertson

[11] 4,116,414

[45] Sep. 26, 1978

[54] BOOK HOLDER

[76] Inventor: Vivian Robertson, 1100 SW. 12th St., Ft. Lauderdale, Fla. 33315

[21] Appl. No.: 857,242

[22] Filed: Dec. 5, 1977

[51] Int. Cl.[2] ..... A47B 97/04

[52] U.S. Cl. ..... 248/451; 248/465

[58] Field of Search ..... 248/451, 460, 463, 464, 248/465

[56] References Cited

U.S. PATENT DOCUMENTS

| | | | |
|---|---|---|---|
| 261,993 | 8/1882 | Brown | 248/451 |
| 813,227 | 2/1906 | Miller | 248/451 |
| 875,220 | 12/1907 | Smith | 248/465 |
| 1,198,180 | 9/1916 | Berg | 248/463 |
| 2,006,887 | 7/1935 | Doherty | 248/451 |

*Primary Examiner*—William H. Schultz
*Attorney, Agent, or Firm*—Robert D. Farkas

[57] ABSTRACT

A book holder utilizes a flat rigid sheet having a bar fixedly secured thereto and extending along the marginal edge of the sheet and outstanding therefrom. Another sheet is hingeably secured to the bar carrying sheet at an opposed marginal edge. A flexible slat is secured to an opposite edge of the hingeable sheet and is also secured to the bar carrying sheet on a surface opposite to the location of the bar. A pair of clothespin-like pinching devices are attached to a pair of flexible cord-like members on the surface of the bar carrying sheet. In use, the book holder may be supported on a horizontal resting surface by having the bar carrying sheet left inclined relative to the supporting surface and utilizing the clamping devices to maintain the pages of a book open when the cover of the book rests on the bar carrying surface of the bar carrying sheet.

10 Claims, 4 Drawing Figures

BOOK HOLDER

BACKGROUND OF THE INVENTION

1. The Field of the Invention

This invention relates to book holders and more particularly to that class of holder adapted to be folded up when not in use so as to occupy a minimum amount of space.

2. Description of the Prior Art

The prior art abounds with book holders of diverse construction. U.S. Pat. No. 3,476,348 issued Nov. 4, 1969 to G. H. Rustad describes an elongated bar having a groove therein to which is secured a rectangular rigid sheet material. A pair of curved arms extend outwardly from the ends of the bar and are secured at preferred angular relationships, in aligned position, relative to the plane of the rigid sheet, utilizing a pair of winged nuts, acting as clamps therefore. The curved bars are coupled to a pair of essentially U-shaped arms, each being equal relative to the curved arms. Thus, the Rustad apparatus may be folded up into a flattened condition and may have its bar and sheet portions disposed on an inclined level relative to the uppermost surface of a table or the like when the wing nuts are tightened and the arms are disposed having straight portions thereof residing on the supporting surface. Rustad does not provide any device suitable for carrying a book in an open condition such that the pages of the book will not automatically close when subjected to the forces of the wind and the like.

U. S. Pat. No. 3,550,895 issued on Dec. 29, 1970 to J. S. Guiles discloses a foldable desk consisting of interconnected front, bottom, rear, and top walls having parallel fold lines and increasing in width in the order named with a foldable flap at the free edge of the top wall secured to the front wall below its free edge. In the collapsed position of the desk, the top and front walls lie flat against the rear and bottom walls and in the erected position, the top wall is inclined downwardly towards the front and bottom walls and the free edge of the front wall is exposed as a retainer. Guiles though teaching a very inexpensive apparatus, which is foldable in nature, fails to provide for book retaining apparatus which maintains the book pages in open condition at selected pages thereof.

U.S. Pat. No. 3,718,308 issued Feb. 27, 1973 to P. E. Hainault describes a book support having a horizontal tension member and a compression member and a hinged connection between the two about which they can pivot between a collapsed position, wherein one overlies the other, and an extended position, wherein the latter is generally upright and at an angle to the former. A second tension member is connected to both of the already mentioned members and is arranged to be extended in a taut condition between the two when they are pivoted to the extended position. The horizontal tension member has an end extending beyond the point of connection of the second tension member thereto. This end has a non-skid surface for engaging a book edge as the book is rested against the compression member, however, the non-skid surface is totally incapable of maintaining the leaves of a book in an open condition since the book cover engages only the non-skid surface whereas the pages of the book are superimposed over the non-skid surface and are free to turn easily due to a memory created in the book binding operation when the book has been fabricated.

SUMMARY OF THE INVENTION

A primary object of the present invention is to provide a book support which may be folded up into a totally collapsed position when not in use.

Another object of the present invention is to provide a book holder which maintains the pages of the book in a secure open position when a book is erected thereon.

Still another object of the present invention is to provide a book holder which is satisfactory in use in a self standing position on a supporting surface or in use when held in a user's hand.

Yet another object of the present invention is to provide a book holder which may be readily fabricated from conventional materials requiring a minimum of specially fabricated parts therefor.

A further object of the present invention is to provide a book holder which may be fabricated from inexpensive materials, durable in nature, and totally suitable for the purposes for which it is intended.

Another object of the present invention is to provide a book holder which is constructed to be totally compatable to retain books of varying sizes thereon.

Still another object of the present invention is to provide a book holder which can double as a map or chart holder.

Yet another object of the present invention is to provide a book holder which may be easily and conveniently used in indoor and outdoor service, and is totally insensitive to the forces of wind and vibration.

A further object of the present invention to to provide a book holder which may be adjustable so as to accomodate books of various thickness as well as books of various sizes, so as to adequately hold the book in an open condition when disposed on the book holder.

Book holders are particularly useful when they are able to provide a self-standing mechanism which holds a book in an open position when rested thereon, such that the book is positioned at an inclined plane forming an acute angle with a horizontal supporting surface, disposed supporting the book holder when in an erected condition. Such book holders are preferably designed so as to accommodate books of various sizes and thickness with equal facility. The prior art, though replete with book holders that collapse when not used, generally fail to provide a combination apparatus which is foldable, capable of accepting books of various thickness and heights and lengths, useful with equal facility when erected on a horizontal supporting surface or in a hand held condition, possessing the capability of maintaining the exposed pages of an open book in a clamped condition, wherein the page clamping apparatus is adjustable to accommodate to various size books as well. The present invention accomplishes these goals and succeeds in doing so by an apparatus which is totally rugged in construction and extremely economical to manufacture. Furthermore, the present invention clasps the edges of the exposed pages of the open book so as to permit total visual access to the indicia carried on such exposed pages. Since the present invention has a minimum of functional moving parts, it may be readily cleaned, thereby enhancing its use as a recipe book holding device, useful in a cooking operation, or for example useful in outdoor service wherein rain, snow, or the like would ordinarily tend to deteriorate the book holders as described in the prior art.

These objects as well as other objects of the present invention, will become more readily apparent after reading the following description of the accompanying drawings.

DESCRIPTION OF THE PREFERRED EMBODIMENT

Figure 1:
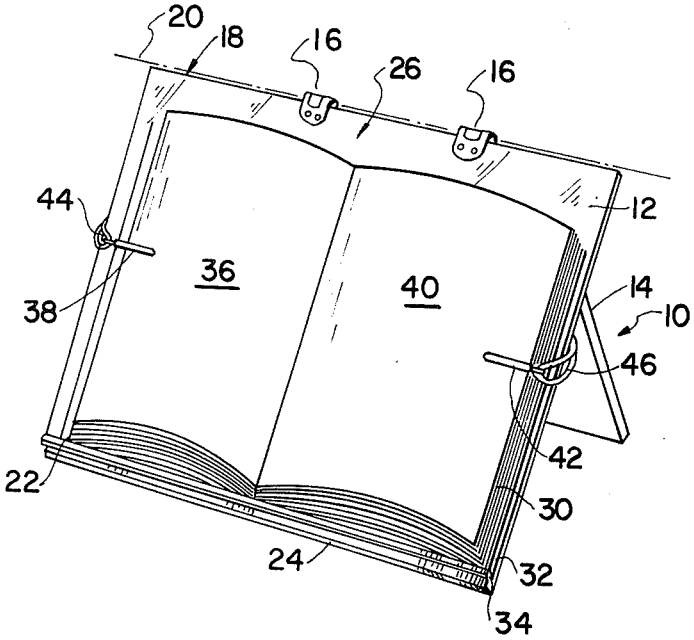
FIG. 1 is a perspective view of the present invention shown having a book thereon.

The structure and method of fabrication of the present invention is applicable to a first elongated rigid rectangular sheet. A first lateral surface of this first sheet is provided having an outwardly extending bar affixed thereto and positioned adjacent a lowermost elongated marginal edge thereof, said bar providing a book supporting surface with a width sufficient to engage the lower edges of a cover portion of a book resting thereon when the first rectangular sheet is disposed at an angle relative to a horizontal plane. A second rigid rectangular sheet is hinged to the first rigid rectangular sheet, so as to pivot adjacent the other lateral surface of a first rigid sheet. A pair of hinges are utilized. Such hinges may be of butt hinge variety, having one plate thereof secured to the book supporting surface of the first rigid sheet and having the other plate thereof secured to a surface of the second rigid sheet such that such surface is disposed outwardly of the combination of the first and second rigid sheets, when such sheets are disposed in parallel relationship. The first rigid sheet and the second rigid sheet may be fabricated from a variety of materials, but are perferably fabricated from a lightweight material, such as a plastic, and more particularly preferably of a transparent rigid plastic material such as polystyrene. Alternately, such plastic material may be cellulose acetate butyrate. The hinges may be fabricated from any convenient material, such as brass or the like. Rivets are utilized to fasten the hinges to the two rigid sheets, in conventional fashion. A flexible strap, preferably fabricated from a fabric-like material, has one end thereof secured to a surface of the second rigid sheet disposed adjacent to the lateral surface of the first rigid sheet, other than the book supporting surface. The other end of the flexible strap is secured to the other than book supporting lateral surface of the first rigid sheet, preferably utilizing a rivet therefor. The length of the flexible strap is such that when the strap is disposed in a taut condition, the first rigid sheet and the second rigid sheet substantially define an equilateral triangle having the hinges at the apex thereof and the bar disposed on the outside of the triangle, on the leg of the first sheet, adjacent the base of such triangle. The flexible sheet extends from the corner angle, opposite the angle adjacent to the bar, to a point substantially midway between the leg of the triangle formed by the first rigid sheet. Thus, the bar extends outwardly from the triangle and is utilized to support the lowermost edges of an open book thereon wherein the book cover resides lying flat on first rigid sheet.

A pair of flexible cord-like elements are provided having one end of each such element secured to the first rigid sheet on the lateral surface other than the bar carrying lateral surface so as to extend inwardly, at a midpoint, from opposed marginal edges each being adjacent to the edge of the first rigid sheet carrying the hinges. The cord-like elements may be non-elastic in nature, if desired, but also may be elastic in nature, similar to shock-cord, frequently found in automotive use. Elastic materials of other varieties may be employed, such as rubber, or the like. Each cord element is secured to the first flexible sheet utilizing a pair of rivets passing through the first rigid sheet therefor. Each cord element is disposed having a bight therein formed by a wire-like member which frictionally clasps portions of the cord element together in adjustable relationship. Thus, the eye of the bight may be positioned dependent upon the location of the wire-like element along the length of the cord element. Such wire-like element may be fabricated from a rigid wire-like material having a pair of C-like ends disposed in back-to-back relationship. Each C-like end has a dimension configured so as to clasp securely the cord-like elements therein. Thus, the bight may be positioned along the length of the cord element. The bight of each cord element passes through an eyelet-like end on one end of a pinching apparatus, similar to a spring-loaded clothespin. Such pinching apparatus may be fabricated from metal or, if desired, from a rigid plastic material such as polypropylene.

In use, the apparatus aforementioned may be disposed in the triangular shape described so as to have the book supporting surface residing at an angle relative to a horizontal supporting surface, such that the bar portion thereof is adjacent to the horizontal supporting surface and outwardly from the triangular shape formed by the present invention. A book is disposed in an open condition having its cover sheets residing on the first rigid sheet and having a pair of pages exposed in full view when the book is opened. The marginal edges on the side of each opposed page, opposite to a fold of the book, are disposed grasped by the clothespin type devices so as to facilitate the reading of the entire indicia carried by such exposed pages. When a smaller book is utilized, the wire-like clamping device is positioned so as to locate the pinching devices a greater distance from the side marginal edges of the first rigid sheet, thereby permiting the pinching apparatus to grasp the exposed pages of such small book. Should the book have a size greater than the width of the first rigid sheet, the greater length cord element permits such larger exposed pages to be grasped with equal facility. In the event that a new book is utilized possessing the characteristics of having an "un-broken" back, and thereby tending to close without encouragement, elastic cord-like elements are employed. Such elastic element also minimize the need to adjust the length of the cord elements when utilizing the present invention on books of diverse sizes and thicknesses. Obviously, the cord elements, by virtue of being adjustable or elastic or both, are quite useful in accommodating books of various thickness and accommodating books wherein the exposed pages reside upon the book in substantially unequal amounts when disposed in left to right relationship residing on the first rigid sheet.

The flexible strap prevents the second rigid sheet from assuming any other angle than the angle which maintains such flexible strap in a totally taut condition, when the second rigid sheet is disposed outwardly angularly from the opposed marginal edge, opposite to the edge adjacent to the bar. If it is desired to utilize the present invention in a hand held condition, the marginal edge of the second rigid sheet, disposed opposite the location of the hinge side thereof, is disposed residing against the adjacent lateral surface of the first rigid sheet thereby preventing the second rigid sheet, otherwise utilized for propping purposes, from interferring with the convenient hand holding operation. Since the entire apparatus is constructed from extremely light, but rugged materials, long-life is anticipated. If it is desired to read the cover of a book, when such book is disposed in the open condition and carried by the first rigid sheet, such first rigid sheet is constructed by a transparent material.

Now referring to the figures, and more particularly to the embodiment illustrated in FIG. 1 showing the present invention 10 having a first rigid rectangular sheet 12 and a second rigid rectangular sheet 14, shown having somewhat smaller width than sheet 12. Hinges 16 are shown adjacent marginal edge 18, of rigid sheet 12. Hinges 16 pivot about a line depicted by dotted lines 20. Bar 22 is shown adjacent to edge 24. Edge 24 is shown opposite to edge 18 and parallel therewith. Bar 22 extends outwardly from surface 26, upon which book 30 is shown resting. Cover 32, of book 30, is disposed in touching relationship with surface 26 and having lowermost edges 34 thereof disposed touching bar 22. Exposed page 36 is clasped by pinching device 38. Exposed page 40, is shown clasped by pinching device 42. Cord element 44 is shown engaged with pinching element 38, in the same fashion that cord element 46 is shown engaged with pinching element 42.

Figure 2:
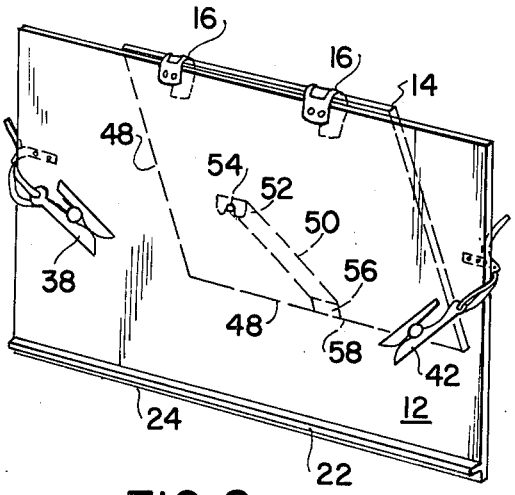
FIG. 2 is a perspective view of the present invention shown in the erected condition.

FIG. 2 illustrates rigid sheets 12 through which rigid sheet 14 is seen, in outline form, utilizing dotted lines 48 therefor. Dotted lines 50 represent a flexible strap having end 52 thereof secured to rigid sheet 12 utilizing rivet 54 therefor. End 56, of flexible strap 50, is secured to rigid sheet 14 adjacent edge 58 thereof.

Figure 3:
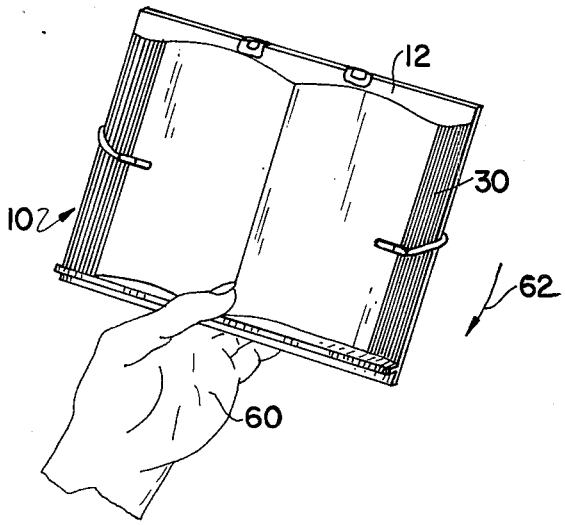
FIG. 3 is a perspective view of the present invention, shown having a book thereon in a hand held position.

FIG. 3 illustrates book 30 shown carried on rigid sheet 12 when rigid sheet 12 is supported by hand 60. In this condition, rigid sheet 14, not shown, may be disposed having edge 58 thereof, not shown, moved in the direction of arrow 62, relative to the position shown in FIG. 2.

Figure 4:
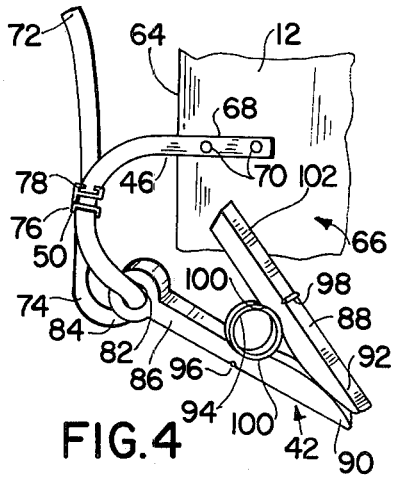
FIG. 4 is a perspective of a portion of the present invention.

FIG. 4 illustrates edge 64 of rigid sheet 12. Edge 64 is disposed intermediate edges 18 and 24, shown in FIG. 1. Surface 66 is an opposed lateral surface to surface 26, shown in FIG. 1. Cord element 46 is shown having end 68 thereof secured to rigid sheet 12, on lateral surface 66, utilizing rivets 70 therefore. End 72, of cord element 46, extends freely from bight portion 74 of cord element 46. Wire-like clasping device 76 is shown having a C-like end 78 in an exposed position whilst having an opposed and oppositely directed C-like end 80 engaging cord element 46. In use, C-like ends 78 and 80 may retain adjacent portions of cord element 46, in a close side-by-side arrangement. Cord element 46 and C-like ends 78 and 80 are configured so as to permit cord element 46 to be moved within C-like ends 78 and 80 in a clasped slidably condition. Pinching device 42 is shown having an eyelet-like opening 82 through which portion 84 of arm 86 and arm 88 are each shown having ends 90 and 92 thereof clasped together by the action of spring 94. Ends 96 and 98, of spring 94, are disposed along the outermost surface of arms 86 and 88 respectively. Spring 94 resides in grooves 100 located within adjacent surfaces of arms 96 and 98, thereby acting as a socket for spring 94 and a pivot point for arms 86 and 88. Ends 90 and 92, of arms 86 and 88 are adapted to clasp exposed pages 36 and 40, shown in FIG. 1. Spring 94 is configured so as to permit ends 90 and 92 to be disposed in spaced apart relationship so as to clasp a large number of pages together, when it is desired to grasp a group of pages, adjacent to open pages 36 and 40, shown in FIG. 1. It should be noted that pinching elements 38 and 42, shown in FIG. 1, are particularly useful when the present invention 10 is utilized in its preferred use, to wit, in a hand held position, as shown in FIG. 3. Elastic member 46, when stretched taut, after being adjusted in length, utilizing wire element 76 therefor, will grasp effectively the pages of a book so as to secure the book to sheet 12 in a secure manner, regardless of the angle which sheet 12 assumes relative to the horizontal.

One of the advantage of the present invention is a book support which may be folded up into a totally collapsed position when not in use.

Another advantage of the present invention is a book holder which maintains the pages of the book in a secure open position when a book is erected thereon.

Still another advantage of the present invention is a book holder which is satisfactory in use in a self standing position on a supporting surface or in use when held in a user's hand.

Yet another advantage of the present invention is a book holder which may be readily fabricated from conventional materials requiring a minimum of specially fabricated parts therefor.

A further advantage of the present invention is book holder which may be fabricated from inexpensive materials, durable in nature, and totally suitable for the purposes for which it is intended.

Another advantage of the present invention is a book holder which is constructed to be totally compatable to retain books of varying sizes thereon.

Still another advantage of the present invention is a book holder which can double as a map or chart holder.

Yet another advantage of the present invention is a book holer which may be easily and conveniently used in indoor and outdoor service, and is totally insensitive to the forces of wind and vibration.

A further advantage of the present invention is a book holder which may be adjustable so as to accommodate books of various thickness as well as books of various sizes, so as to adequately hold the book in an open condition when disposed on the book holder.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows.

I claim:

1. A book holder comprising a first rigid sheet, a second rigid sheet, an elongated bar, said first rigid sheet having said elongated bar fixedly secured thereto, said elongated bar being located on a first lateral surface of said first rigid sheet adjacent a first marginal edge thereof, the longitudinal axis of said elongated bar being disposed parallel to said first lateral surface of said first rigid sheet, said second rigid sheet hingeably secured to said first rigid sheet at a second marginal edge of said first rigid sheet, said first marginal edge and said second marginal edge of said first rigid sheet being disposed in parallel spaced apart relationship, said second rigid sheet having a first marginal edge thereof disposed substantially parallel to said first marginal edge of said first rigid sheet, said second rigid sheet having a second marginal edge thereof being located adjacent said second marginal edge of said first rigid sheet, said first marginal edge and said second marginal edge of said second rigid sheet being disposed in parallel spaced apart relationship, a flexible strap, one end of said flexible strap being disposed fixedly secured to a second lateral surface of said first rigid sheet, the other end of said flexible strap being disposed fixedly secured to said second rigid sheet at a location adjacent said first marginal edge thereof, a pair of cord-like elastic elements, one end each of said pair of cord elements fixedly secured to said second lateral surface of said first rigid sheet at a location adjacent a pair of opposed marginal edges extending transverse to said first marginal edge of said first rigid sheet, means to secure a portion of said each of said pair of cord element in a bight, a pinching device, said pinching device having a pair of arms, one end of one of said pair of arms having an eyelet-like opening, a portion of said bight passing through said opening, said means to secure including means to manually selectively adjust the length of said bight.

2. The apparatus as claimed in claim 1 wherein said means to secure comprises a wire-like element, said wire-like element having a pair of opposed C-like ends, said opposed, C-like ends configured to slideably engage said cord element therewithin.

3. The apparatus as claimed in claim 1 wherein said pinching device further comprises a spring, said spring having the ends thereof disposed coupled to each of said pair of arms, said spring being located intermediate adjacent surfaces of each of said pair of arms, said spring being disposed intermediate said one end of said one arm and the other end thereof, said spring being disposed located intermediate one end of the other of said pair of arms and the other end of said pair of arms, said one end of said one arm and said one end of said other arm being located adjacent one another, whereby said spring biases said other end of said one arm towards said other end of said other arm.

4. The apparatus as claimed in claim 1 wherein said cord element comprises a rubber-like material.

5. The apparatus as claimed in claim 1 wherein said cord element comprises shock cord.

6. The apparatus as claimed in claim 1 wherein said first rigid sheet is transparent.

7. The apparatus as claimed in claim 1 further comprising a pair of hinges, one end of each of said pair of hinges being disposed fixedly secured to said first rigid sheet adjacent said second marginal edge thereof, the other end of said pair of hinges being disposed fixedly secured to said second rigid sheet adjacent said second marginal edge thereof.

8. The apparatus as claimed in claim 1 wherein said flexible strap is configured having a length whereby said first rigid sheet and said second rigid sheet are disposed substantially forming a pair of sides of an equilateral triangle when said flexible strap is maintained in a taut condition.

9. The apparatus as claimed in claim 1 wherein said second rigid sheet is a rectangle.

10. The apparatus as claimed in claim 1 wherein said pair of cord elements are disposed secured to said first rigid sheet having rivets passing therethrough and clampingly securing said cord element to said first rigid sheet.

* * * * *